US007520310B2

(12) United States Patent
Colosio

(10) Patent No.: US 7,520,310 B2
(45) Date of Patent: Apr. 21, 2009

(54) APPARATUS FOR ADJUSTING THE POSITION OF THE SLATS OF VENETIAN BLINDS AND VENETIAN BLIND

(75) Inventor: Mauro Colosio, Concesio-Brescia (IT)

(73) Assignee: Ober S.R.L., Brescia (IT)

( * ) Notice: Subject to any disclaimer, the term of this patent is extended or adjusted under 35 U.S.C. 154(b) by 717 days.

(21) Appl. No.: 10/746,289

(22) Filed: Dec. 29, 2003

(65) Prior Publication Data

US 2004/0149399 A1 Aug. 5, 2004

(30) Foreign Application Priority Data

Dec. 30, 2002 (EP) ..... 02425810

(51) Int. Cl.
*E06B 9/308* (2006.01)

(52) U.S. Cl. ..... 160/168.1 R; 160/178.1 R; 160/168.1 P; 160/176.1 R

(58) Field of Classification Search ..... 160/168.1 P, 160/168.1 R, 176.1 P, 176.1 R, 173 R, 177 R, 160/178.1 R See application file for complete search history.

(56) References Cited

U.S. PATENT DOCUMENTS

| | | | | |
|---|---|---|---|---|
| 4,020,889 | A * | 5/1977 | Karoll | 160/120 |
| 4,522,244 | A | 6/1985 | Brolin | |
| 5,390,721 | A * | 2/1995 | Oskam et al. | 160/168.1 V |
| 6,619,365 | B1 * | 9/2003 | Wen et al. | 160/168.1 P |
| 2003/0000654 | A1 * | 1/2003 | Welfonder | 160/168.1 P |

FOREIGN PATENT DOCUMENTS

WO WO 02/057586 A1 7/2002

* cited by examiner

*Primary Examiner*—Blair M. Johnson
(74) *Attorney, Agent, or Firm*—Hogan & Hartson LLP

(57) ABSTRACT

An apparatus for adjusting the position of the slats of Venetian blinds comprises means for packing and extending the slats, means for adjusting the angular position of the slats and lost-motion means interposed functionally between the said packing and extending means and the said adjustment means in such a way as to lock the said Venetian blind adjustment means after a predetermined number of rotations of an actuating shaft. The lost-motion means comprise three toothed elements in functional sequence, a first one of which is functionally connected to the said slat packing and extending means and a third one of which is functionally connected to the said adjustment means. The toothed elements are housed inside each other.

5 Claims, 19 Drawing Sheets

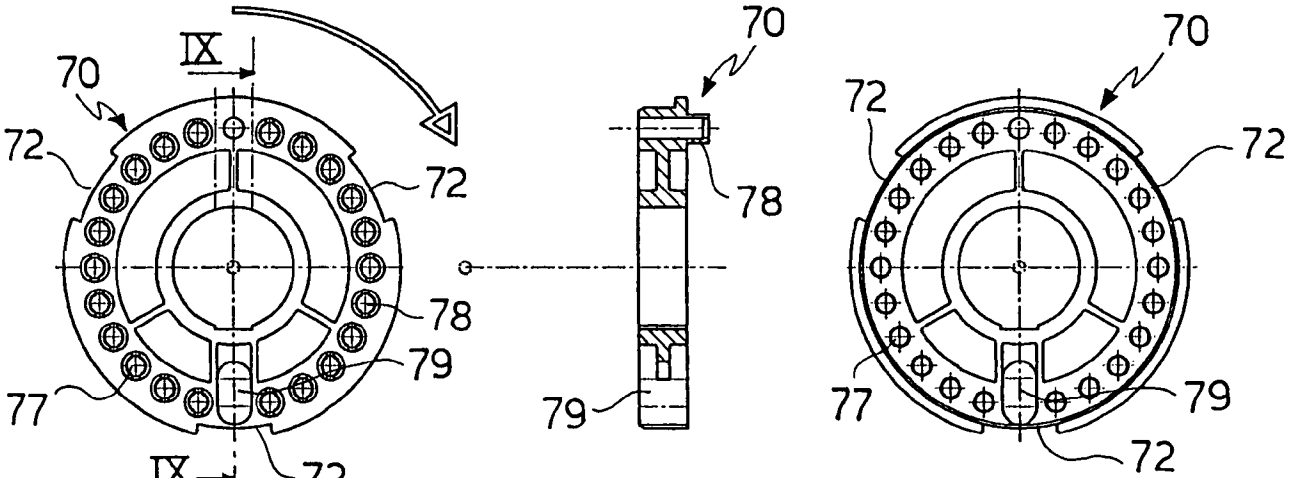
FIG. 8
FIG. 9
FIG. 10
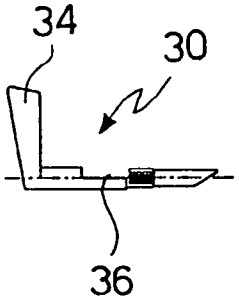
FIG. 7
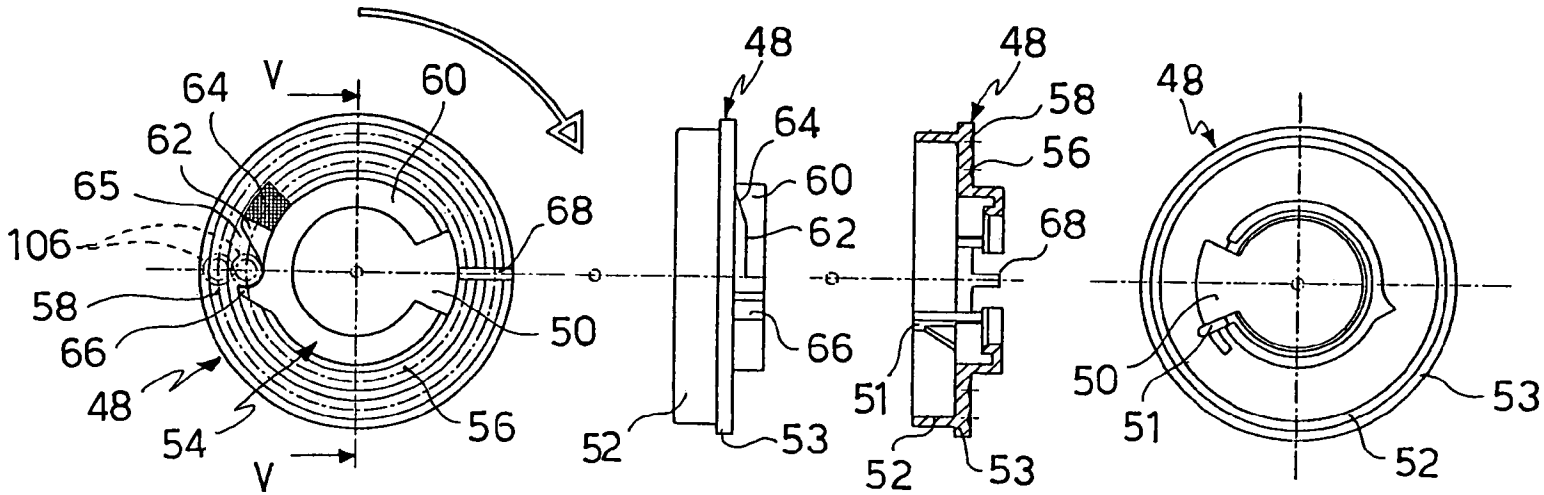
FIG. 3 FIG. 4 FIG. 5 FIG. 6

APPARATUS FOR ADJUSTING THE POSITION OF THE SLATS OF VENETIAN BLINDS AND VENETIAN BLIND

FIELD OF THE INVENTION

The present invention relates to an apparatus for adjusting the position of the slats of Venetian blinds and a corresponding Venetian blind.

BACKGROUND OF THE INVENTION

As is well known, Venetian blinds of the type indicated above consist of a plurality of slats that can be packed flat, placing them in contact with each other, or extended to cover the area of a window, for example.

It is also known that the slats can be adjusted by rotating them relative to a horizontal plane, to give a plurality of positions. These positions range between the position in which the slats are essentially horizontal, and therefore do not obscure the window area, and the position in which the slats completely obscure the window area.

To pack or extend the slats, a winding apparatus generally comprising two or more cords attached to the slats is provided. Winding or unwinding these cords causes the slats to pack or unwind in the plane of the window.

The angular orientation of the slats can also be adjusted using cords attached to two sides of the slats. By acting on either one end or the other of the cord the slats are made to rotate about a horizontal plane. It will be clear from the above that the angular adjustment is the same for all the slats, which are therefore made to rotate simultaneously as one.

The prior art includes apparatuses which by a single rotation of a motorized shaft actuate both the slat packing and extending means, and the means that adjust the slat angle.

During the phase of extension it is preferable that the slats be locked in a predetermined angular position, also known as the "third position", corresponding to an angle of about 38° relative to the horizontal plane. It is preferable for the resetting of the said third position to occur during the phase of packing and only after a certain number of rotations of the shaft actuating the apparatus. For this purpose the prior art includes mechanisms which delay the locking of the adjustment means, consisting for example of an axial sequence of discs which in sequence lock onto each other until they lock the angular setting of the slats.

These mechanisms are not particularly effective because the interaction between the individual discs occurs only when one is locked onto the next. In addition, these mechanisms require a lot of axial space and increase the weight of the structure of the apparatus.

The problem solved by the present invention is that of providing a Venetian blind and an apparatus for adjusting the position of the slats of Venetian blinds, whose structural and functional characteristics shall be such as to fulfil the abovementioned requirements and at the same time to overcome the abovementioned drawbacks cited with reference to the prior art.

SUMMARY OF THE INVENTION

This problem is solved with an apparatus for adjusting the position of slats of Venetian blinds in accordance with claim 1.

BRIEF DESCRIPTION OF THE DRAWINGS

Other characteristics and advantages of the Venetian blind and of the apparatus for adjusting the position of the slats of Venetian blinds according to the invention will be found in the following description of a preferred illustrative example thereof, given by way of non-restrictive indication, with reference to the accompanying figures, in which:

FIGS. 3-6 are enlarged front end, side, diametrical sectional (on the plane V-V) and rear end views, respectively, of a detail of FIG. 1;

FIG. 7 is an enlarged side view of a detail of FIG. 1;

FIGS. 8-10 are enlarged front end, sectional (on the plane IX-IX) and rear end views, respectively, of a detail of FIG. 1;

DETAILED DESCRITPION OF THE INVENTION

Figure 1:
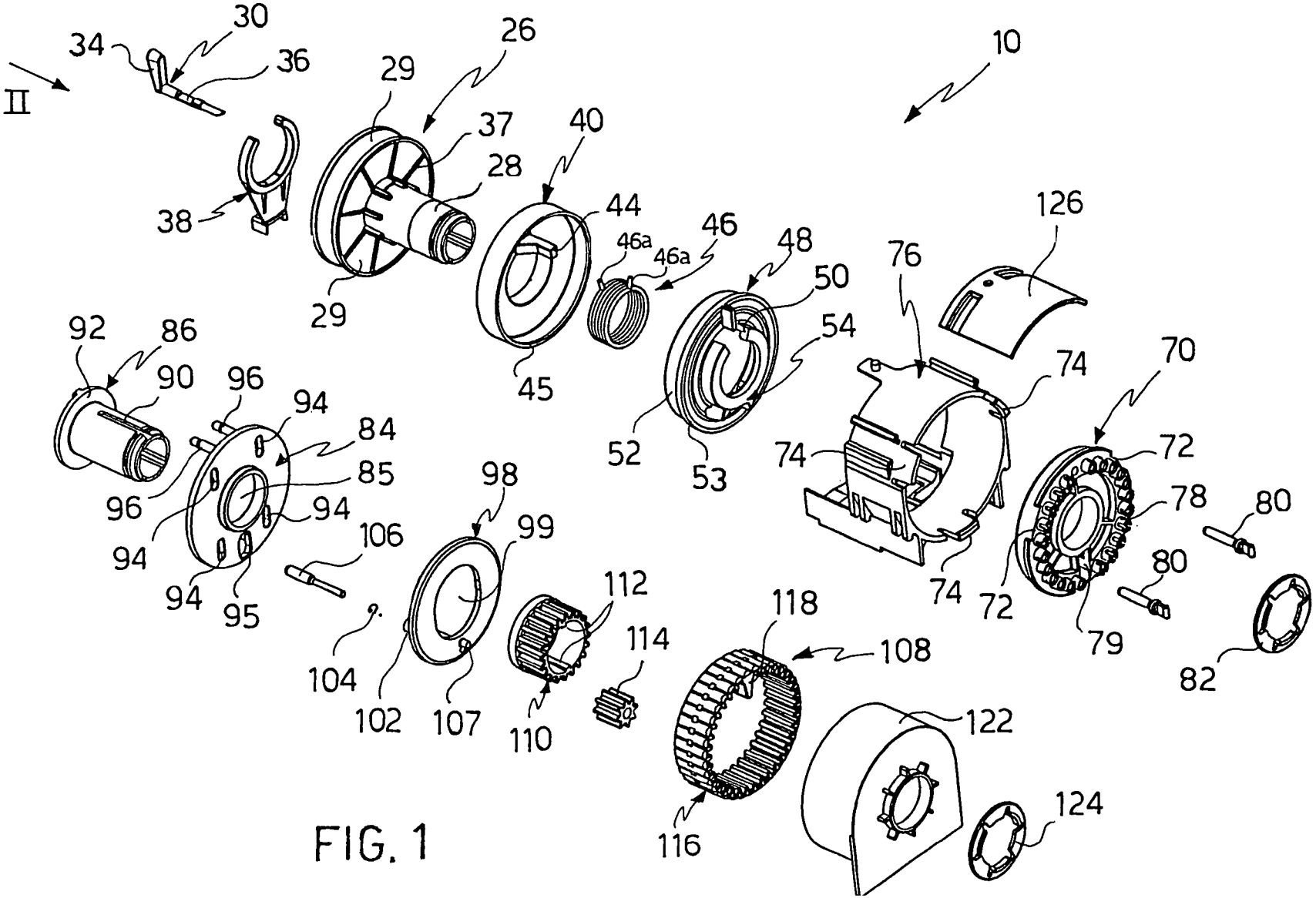
FIG. 1 is an exploded perspective view of an apparatus according to the present invention.

With reference to FIGS. 32A-32E, the number 10 is a general reference for an apparatus for adjusting the position of the slats 12 of Venetian blinds 14. Venetian blinds 14 usually consist of a plurality of slats 12 which may be made of a variety of materials, such as metals or plastics. The slats 12 are elongate in a predominant direction 16 and, transversely to the said dominant direction, may be of flat or curved section.

The slats 12 are usually arranged one above the other in several layers, in a direction perpendicular to the said predominant direction and are connected to each other in such a way that it is possible to vary both the distance between the slats and the orientation of the slats about the said predominant direction. In particular, the predominant direction is horizontal and the slats are arranged one above the other in the vertical direction. The angle of the slats is adjusted by rotating them relative to a horizontal plane.

In the solution illustrated, the slats are connected by cords or lines 18 arranged in at least two positions along the predominant direction 16. Each cord is arranged in front of and behind the Venetian blind, and down its length is hooked to each slat 12. The slats are therefore hung from these cords and, when the latter are fully extended, the maximum distance between the slats is equal to the distance between the attachment points of the slats along the cords.

Each cord 18 has a portion in front of the blind, a portion behind the blind, and curves over the top of the blind. At the point at which it curves over the top of the blind, the cord is controlled by means for adjusting the angle of the slats, as will be described later.

Other tapes 20 having an end stop 22 pass through all the slats 12 through slots 24. The stop end of the tape is underneath the last slat while the other end is attached to means for raising and lowering the slats as will be described later.

In a first possible embodiment, the apparatus for adjusting Venetian blinds 10 comprises a spool 26 comprising a hollow shaft 28 (FIGS. 11-14) which extends along an axis 28*a* and two essentially circular flanges 29 that extend at right angles to said axis. The flanges define an annular space around the shaft 28 for the tape 20 which raises and lowers the slats. The transverse cross section of the hollow shaft may be of numerous shapes provided it forms a positive fit with a drive shaft T suitable for transmitting the rotary motion.

As illustrated in FIG. 1 the axis 28*a* defines an axial direction for all the parts of the apparatus 10. A radial direction is consequently a direction lying in a plane perpendicular to the said axis 28*a* and intersecting this axis.

In one possible embodiment a lever 30 is designed to be inserted into a seat 32 in the spool that extends along the surface of the hollow shaft 28 between the two flanges 29. The lever 30 (FIG. 7) has an adjustment arm 34 which remains outside of the spool 26. On an operational part of the lever 30 is a recess 36, preferably of rectangular shape, the purpose of which is to vary, depending on the position of insertion of the lever 30 into the seat 32, what length of tape 20 is wound onto the spool 26.

Ribs 37 are formed in an axial direction along part of the axial surface of the hollow shaft 28 beginning at the flanges 29.

In one possible embodiment, a bearing 38 supports the spool 26 via the hollow shaft 28.

In one possible embodiment, an annular line holder 40 is mounted coaxially on the hollow shaft 28 of the spool 26, on the opposite side from the lever 30. The side next to one of the flanges 29 comprises means for gripping the line 18 which controls the angular position of the slats and in particular a seat 42 for clamping a portion of the line 18 or a block 43 attached to the line 18. On the other side of the annular line holder 40 is an axial dog 44 extending away from the spool 26. The outer edge of the line holder 40 consists of a circular wall 45 which extends axially.

A helical spring 46, preferably made of stainless steel, is mounted with interference coaxially onto the hollow shaft 28 immediately after the line holder 40. The ends 46*a* of the helical spring 46 extend radially for a distance and sit either side of the axial dog 44.

The ribs 37 of the spool 26 are designed to create a radial movement coupling between the hollow shaft 28 and the line holder 40 and also, in the axial position, create a stop for the spring 46.

A cam element 48 of essentially annular shape is mounted coaxially on the hollow shaft 28 of the spool 26. 50 denotes an angular slot able to receive the axial dog 44 of the line holder 40 and the ends 46*a* of the spring 46. At one end of the radial slot 50 is an axial dog 51 which extends towards the line holder 40. In the connection between the line holder 40 and the cam element 48, the axial dog 44 of the line holder 40 is located between the ends 46*a* of the spring 46, and the axial dog 51 of the cam element 48 is located externally relative to one end 46*a* of the helical spring 46.

The cam element 48 comprises a circular wall 52 that extends axially at a distance from the axis 28*a* of slightly less than the radial distance of the circular wall 45 of the line holder 40. In the connection between the line holder 40 and the cam element 48, the circular wall 45 of the line holder 40 surrounds the circular wall 52 of the cam element 48 and abuts against an annular portion 53 whose radial extension is greater than that of the circular wall 52.

The side of the cam element 48 furthest from the line holder 40 comprises a cam 54 having two different paths 56 and 58 at different radial distances from the axis 28*a* (chain line in FIG. 3). A circular rib 60, interrupted by the angular slot 50, defines the inner path 56, that is the path nearest the axis 28*a*, on the inward side.

At a point along this inner path 56 is a step 62 having, on one side, an inclined surface 64 with respect to the surface of the cam element, and on the other a wall 65 essentially perpendicular to the surface of the cam element. The wall 65 is inclined with respect to a radial direction. At a point along the inner path 56 there is also a stop element 66 in the form of a tooth which, in one possible embodiment, extends radially from the circular rib 60.

A wall 68 extends perpendicularly from the surface of the cam element 48 in an axial direction, on the opposite side from the axial dog 51. The wall 68 extends in a radial direction from the outer edge of the cam element 48 through both the inner path 56 and the outer path 58.

The number 70 denotes an additional cam element, having an essentially annular configuration and mounted coaxially on the hollow shaft 28. In one possible embodiment, the outer edge of the additional cam element 70 comprises seats 72 for the insertion of teeth 74 of a first casing 76. The additional cam element 70 is thus fixed with respect to the first casing 76.

An outer annular portion of the additional cam element 70 has holes 77 uniformly distributed around the circumference. On the side remote from the cam element 48, holes 77 are defined by seats 78 which extend axially from the surface of the additional cam element 70.

An elongate slot 79 extends in a radical direction on the outer portion of the additional cam element 70. Two pins 80 are designed to be inserted into the holes 77 in different angular positions to act as end stops for the cam element 48, by stopping the latter rotating by interference with the wall 68 and at the extreme angular positions of the slats 12.

In one possible embodiment a stop ring 82 is designed to be mounted on the projecting end of the hollow shaft 28 so as axially to secure the parts listed above.

The apparatus 10 as defined above is capable of packing and extending the slats of a Venetian blind and orienting them between two extreme angular positions. The assembled parts described above are preferably inserted inside the casing 76.

Figure 32A:
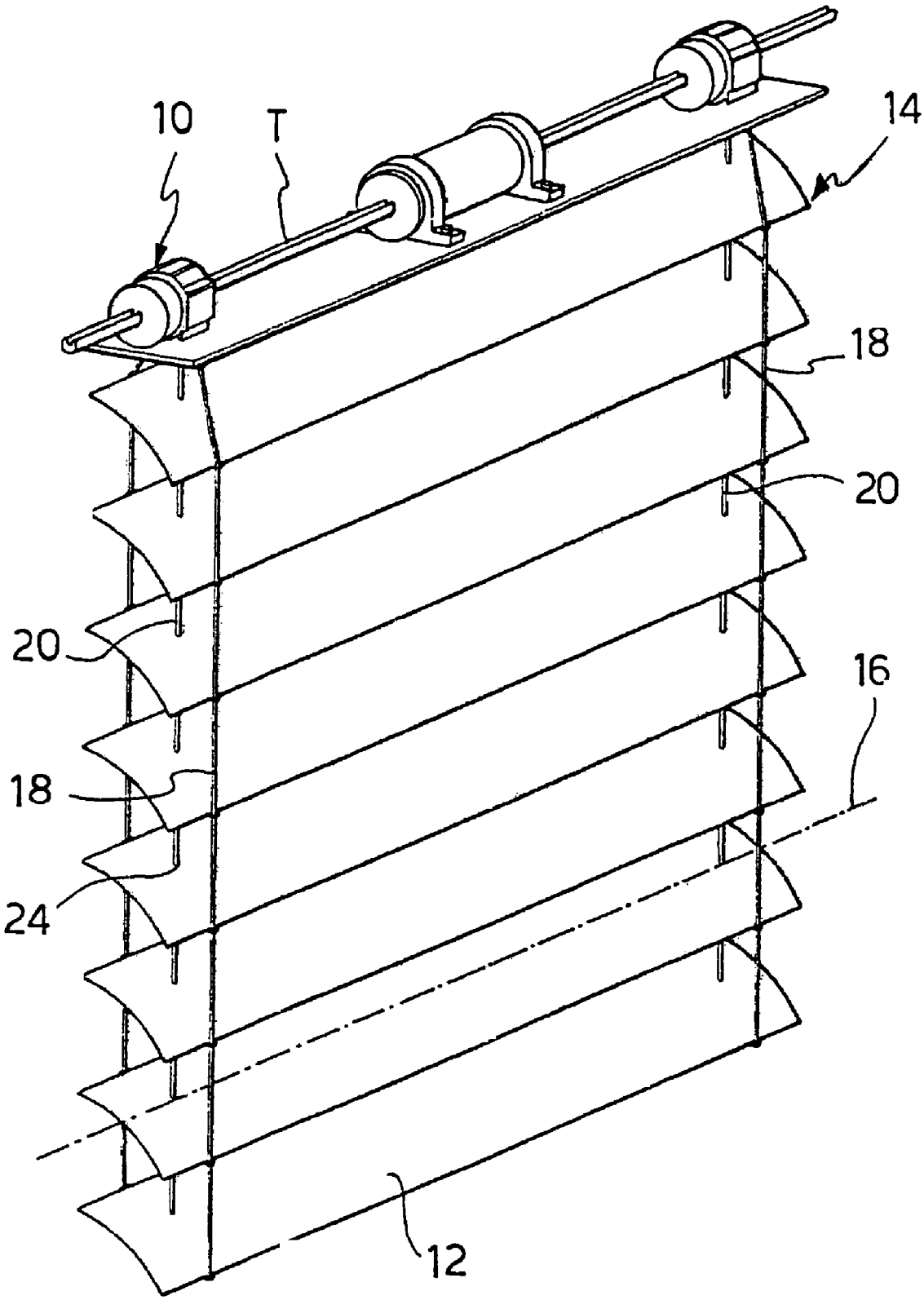
FIG. 32A is a perspective view of a portion of a Venetian blind.
Figure 32E:
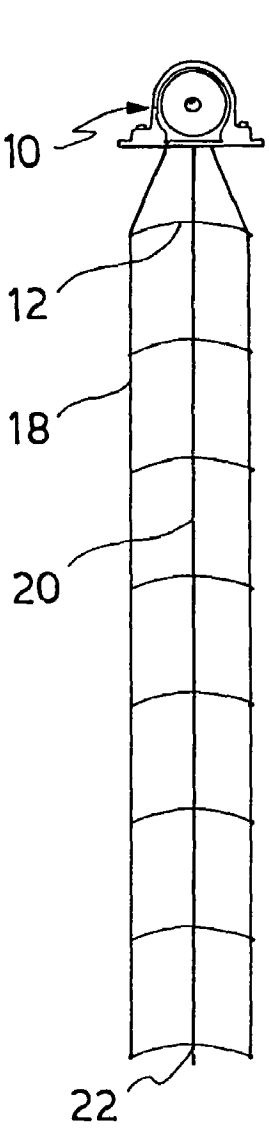
FIGS. 32B-32E show a side view of the Venetian blind of FIG. 32A in different operational conditions.
Figure 32D:
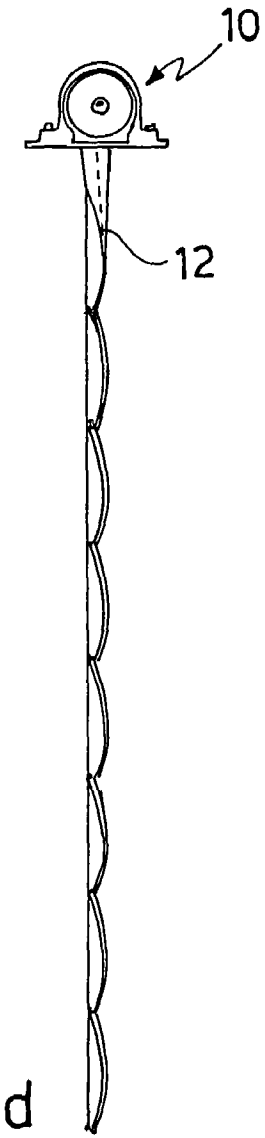
Figure 32C:
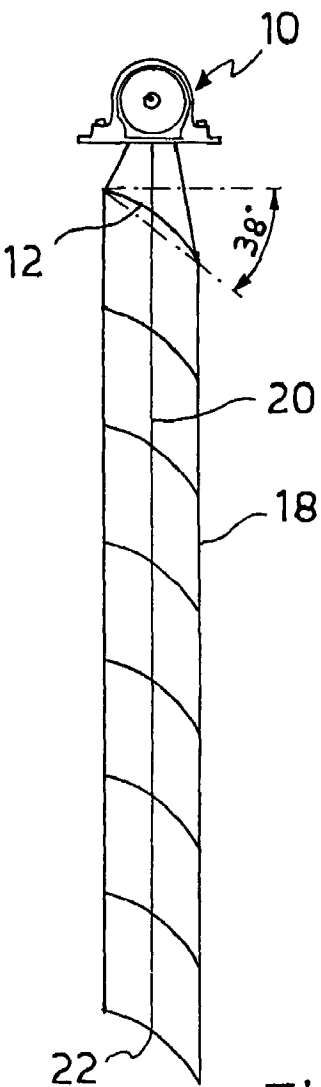
Figure 32B:
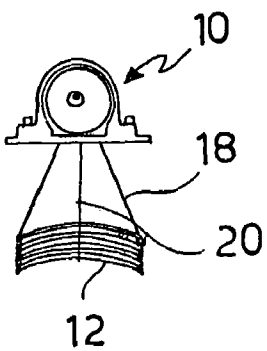

The other parts which will be described below define means for activating and deactivating the so-called "third position", meaning the locking of the slats in a special angular position of approximately 38° with respect to the horizontal plane while the slats are being extended (FIG. 32C).

In one possible embodiment, a release ring 84 is designed to be fixed to the additional cam element 70. This release ring 84 contains a central hole 85 designed to receive an additional spool 86. This additional spool 86 comprises a hollow shaft 88 extending parallel to the axis 28*a*. The internal cross section of the hollow shaft 88 may take numerous shapes provided it creates a positive fit with the drive shaft (not shown) used to transmit the rotary motion. The outer surface of the hollow shaft 88 includes at least one axial channel 90 extending from one end of the hollow shaft. From the other end of the additional spool 86 there radially extends a circular flange 92 whose radial dimensions are greater than the radial dimensions of the central hole 85 of the release ring 84.

The additional spool 86 is inserted into the release ring 84 until the circular flange 92 defines an axial engagement against the walls of the release ring 84. The release ring 84 has four elongate slots 94 which extend preferably along directions parallel to each other. An additional elongate slot 95 extends in a direction parallel to the elongate slots 94.

Four pins 96 extend axially from the side against which the flange 92 of the additional spool 86 is intended to be placed. The free ends of the pins 96 are intended to fit into the seats 78 of the additional cam element 70. The additional cam element 70 and release ring 84 are connected together by the interaction between the pins 96 and the seats 78. In particular the additional cam element 70 and the release ring 84 do not rotate relative to the first casing 76.

The number 98 denotes a slider which, in one possible embodiment, is essentially in the form of a disc and is designed to be mounted coaxially on the hollow shaft 88 of the additional spool 86.

The slider 98 has a central hole 99 of oval shape to allow the slider 98 to move transversely relative to the axis 28*a*.

The slider 98 has on one side four pins 100 that extend axially towards the release ring 84. These pins are arranged so as to fit into the elongate slots 94 in the release ring 84. On the same side as the pins 100, the slider 98 also has a cylindrical seat 102 that extends axially towards the release ring 84 and towards the additional cam element 70. The cylindrical seat has an open end designed to fit into the elongate slot 95 of the release ring 84 and into the elongate slot 79 of the additional cam element 70.

An elastically acting element 104, preferably a helical spring, is inserted into the cylindrical seat 102. A pin 106 is inserted into the cylindrical seat 102 and pushed outwards by the spring 104. The pin 106 positions itself against the surface of the cam element 48 and is designed to slide around either of the two paths 56 or 58.

On the opposite side to the cylindrical seat 102, the slider 98 comprises a pin 107 extending in an axial direction.

Lost-motion means 108 are mounted on the additional spool 86, and are functionally interposed between the additional spool 86 and the slider 98.

These means comprise a first toothed element 110 mounted coaxially on the hollow shaft 88 of the additional spool 86. The first toothed element 110 consists of a cylindrical wall with external teeth. At least one axial rib 112 extends along the inside of the cylindrical wall and is designed to engage with the axial channel or channels 90 of the hollow shaft 88.

The means 108 comprise a second toothed element 114 in the form of a planet gear defined by a cylindrical wall with external teeth designed to mesh with the teeth of the first toothed element 110.

The means 108 also include a third toothed element 116 comprising a cylindrical wall with internal teeth designed to mesh with the teeth on the second toothed element 114. One of the teeth is larger in the radial direction and forms a stop element 118.

At the stop element 118, the third toothed element 116 comprises a ramp 120 formed by a wall whose edge has opposing inclinations and whose vertex is directed towards the axis of rotation 28*a*.

The three toothed elements fit inside each other, limiting the axial size of the apparatus.

A second casing 122 closes the lost-motion means 108 and a stop ring 124 locks the parts cited above axially on the hollow shaft 88.

If required, a cover 126 may close the top of the apparatus 10.

The operation of the apparatus 10 described above is as follows.

The drive shaft (not shown) turns both the spool 26 and the additional spool 86. The spool 26 and its drive shaft belong to means for packing and extending the slats of the blind while the line holder 40, together with the parts for rotating it, belong to means for adjusting the angular position of the slats.

Depending on the direction of rotation, the tape 20 either winds or unwinds, so lowering or raising the slats.

Simultaneously the hollow shaft 28 turns, by means of the spring 46, the line holder 40 and, through the axial dog 44, the cam element 48.

Simultaneously the drive shaft turns the additional spool 86, the first toothed element 110 and the second toothed element 114. When this last meets the stop element 118, the toothed elements become as one in their rotation about the axis 28*a*, with the consequence that the second toothed element 114 turns the third toothed element 116.

When the ramp 120 meets the axial pin 107 of the slider 98, the latter is moved along the slots 94 of the release element 84 from an outer position to an inner position.

Simultaneously the pin 106 of the slider 98 moves from the outer path 58 to the inner path 56 of the cam element 48. It is only while the slats are being extended, and because of the presence of the step 62 and inclined surface 64 of the stop element 66, that the cam element 48 locks against the cylindrical seat 102 of the slider 98.

The interaction between the axial dog 44 of the line holder 40 and the angular slot 50 of the cam element 48 stops the line holder 40 rotating and relaxes the helical spring 46. In this way the angle of the slats remains constant during the lowering of the blind (third position).

The three toothed elements 110, 114 and 116 that form lost-motion means 108 have the effect of delaying the locking of the cam element 48 against the cylindrical seat 102 of the slider 98. Specifically, the slider 98 is moved transversely to the axis 28*a* after a predetermined number of revolutions of the drive shaft. In other words, only after a predetermined number of revolutions does the cylindrical seat 102, inside which the pin 106 slides, move from the outer path 58 to the inner path 56 and can then interact with the stop element 66.

To release the cam element 48, the shaft is turned in the opposite direction so that the pin 106 of the slider 98 moves along the wall 65, which is inclined with respect to the radial direction, and is pushed outwards so that it interacts with the outer path 58. With the pin 106 in this position, both the line holder 40 and the spool 26 are free to rotate.

FIG. 3 shows in chain line the pin 106 in two different positions in which it interacts either with the inner path or with the outer path.

It will be seen from the above that the use of a lost-motion mechanism of the type described above makes it possible with great precision and reliability to delay the locking of the adjustment of the slat angle (which is generally fixed at 38° with respect to the horizontal plane). In particular, the construction of this mechanism from a series of interconnected toothed elements limits friction and makes the relative positions of all the parts reliable.

The novel use of a pin moving radially on two different paths of a cam quickly and accurately achieves the desired configuration depending on whether the blind is being raised or lowered.

In particular, the shape of this pin, comprising a part which is movable in the axial direction and is pushed outwards by an elastically acting element, means that contact with the relevant cam path is maintained at all times.

Another advantage of the apparatus according to the invention is its unusually simple structure, enabling it to be produced very inexpensively.

It will be clear that variants of and/or additions to what is described above and illustrated may be made. FIGS. 33-35 and 36-38 show one possible embodiment of two portions of an apparatus 10 according to the present invention. Parts that are the same as in the previous account are indicated by the same reference numbers.

As illustrated in FIGS. 33-35 and 39-42, in one possible embodiment the spool 26 may differ in construction from the above account, for example by having one of the flanges able to be mounted on the hollow shaft 28 rather than formed in one piece with the spool 26. The number 290 denotes the outer flange, made as a separate part from the spool 26. The flange 290 is designed to be mounted axially on the hollow shaft 28. In particular, the flange 290 has a central hole 292 with axial ribs 294. In the example illustrated there are four ribs arranged in a cross shape. The hollow shaft 28 comprises a section 280 located between the flange 29 and the flange 290. This section has axial channels 282, the number and dimensions of which are such as to take the ribs 294. At the seat 32, the channel is preferably completely open, in the sense that it takes the form of a slot through the full thickness of the wall defining the section 280 of the hollow shaft 28.

In one possible further embodiment, the cam element 70 has a number of slots 700 formed in the side wall of this cam element in an axial direction. The form and dimensions of these slots are such as to accommodate a rib 702 formed in a casing 760 of the apparatus. The rib 702 and the slots 700 define means for taking up the play of the joints of the drive shaft: by orienting the cam element 70 with respect to the other parts and to the casing, and connecting the rib 702 with one of the slots 700, it is possible to select the angular position of the cam element 70 in such a way as to take up the radial difference, which is created between the various parts of the drive shaft, as a function of the number of connections and the precision of the joints.

Figure 44:
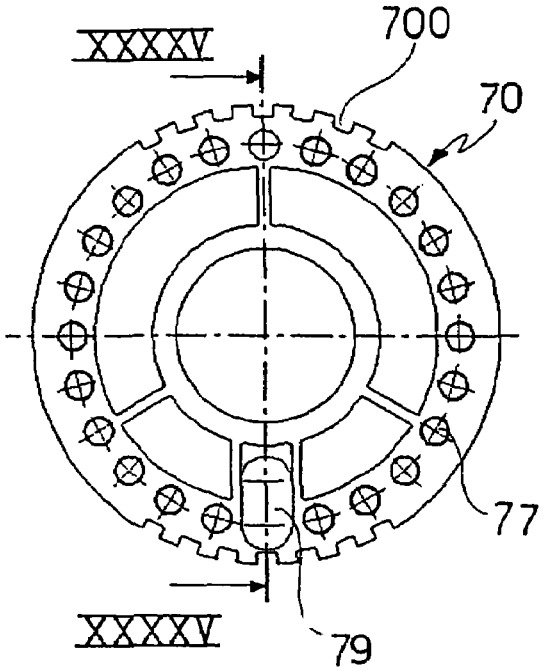
FIGS. 44-46 are enlarged front end, sectional (on the plane XXXXV-XXXXV) and rear end views, respectively, of an embodiment of a detail of FIG. 33.
Figure 45:
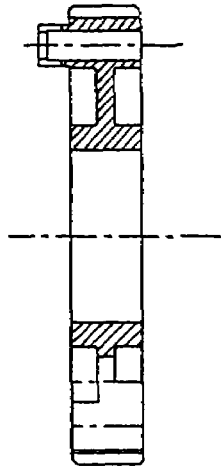
Figure 46:
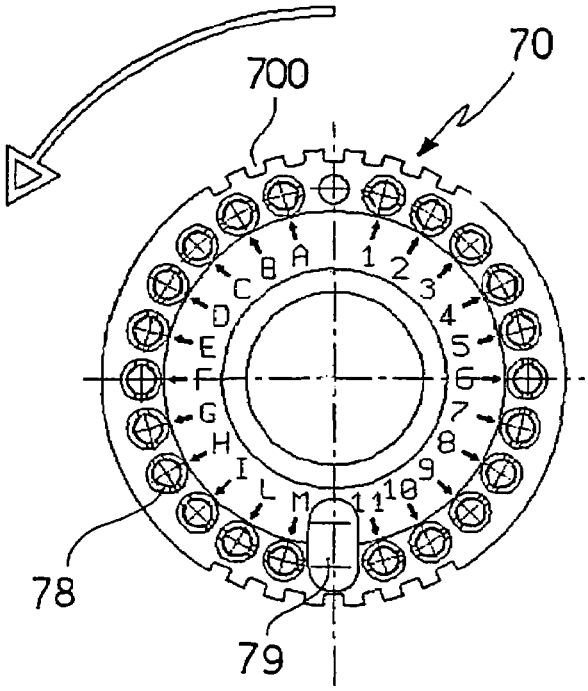
Figure 47:
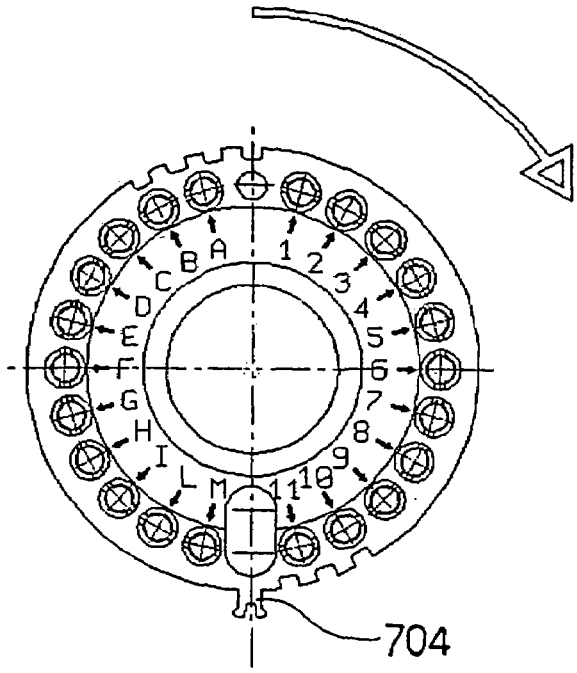
FIG. 47 is an enlarged end view of a possible embodiment of the detail of FIG. 46.
Figure 48:
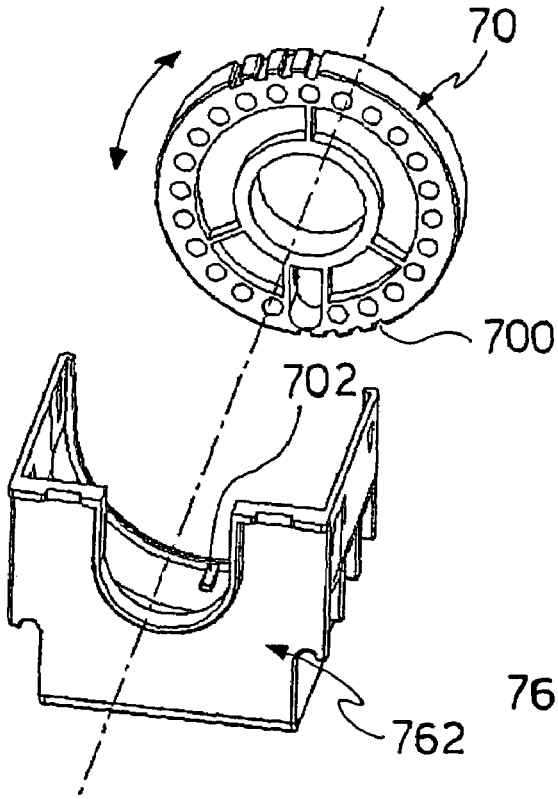
FIGS. 48 and 49 are an enlarged perspective view and an exploded view, respectively, of the connection between two details of FIG. 33, in two different embodiments.
Figure 49:
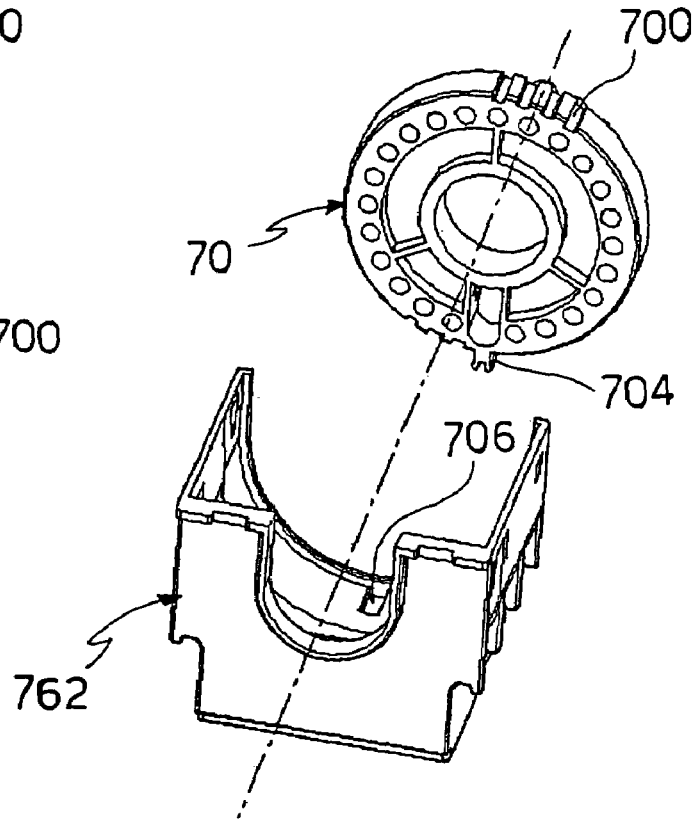

FIGS. 44-46 illustrate a possible embodiment of the cam element 70 and FIG. 47 illustrates a possible further embodiment of the cam element 70. FIGS. 48 and 49 moreover illustrate the process of inserting the cam element 70 into the casing, in two possible embodiments.

FIGS. 44-46 illustrate a cam element 70 with slots 700 formed in two diametrically opposite portions. FIG. 47 and FIG. 49 illustrate a cam element 70 that does not allow the play to be taken up. A tooth 704 is in fact used, with e.g. a spring-release action, which will fit into a depression 706 present on a base 762.

In one possible further embodiment, a casing 760 comprises a base 762 and a cover 764. This arrangement facilitates the insertion of the portion of apparatus which packs and orients the slats, insertion being radial rather than axial. In the case in which a rib 702 is provided, this rib is formed either in the inner wall of the cover 764 or in the inner wall of the base 762.

The portion that packs and orients the slats (FIGS. 33-35) and the portion that activates and deactivates the so-called "third position" (FIGS. 36-38) can be connected together to form an apparatus 10 and are preferably produced independently. As a consequence, the two portions can be made in some other way than as described above. For example an apparatus can be produced that has only the slat packing and orienting portion, without the portion that activates or deactivates the so-called "third position". Alternatively, the embodiments of the slat packing and extending portion may be connected to different embodiments of the portion that activates and deactivates the "third position".

In one possible embodiment, the means for taking up the angle caused by the play in the joints of the drive shaft may be used in any type of apparatus, whether or not the means defining the "third position" are present and irrespective of what form they may take.

Figure 2:
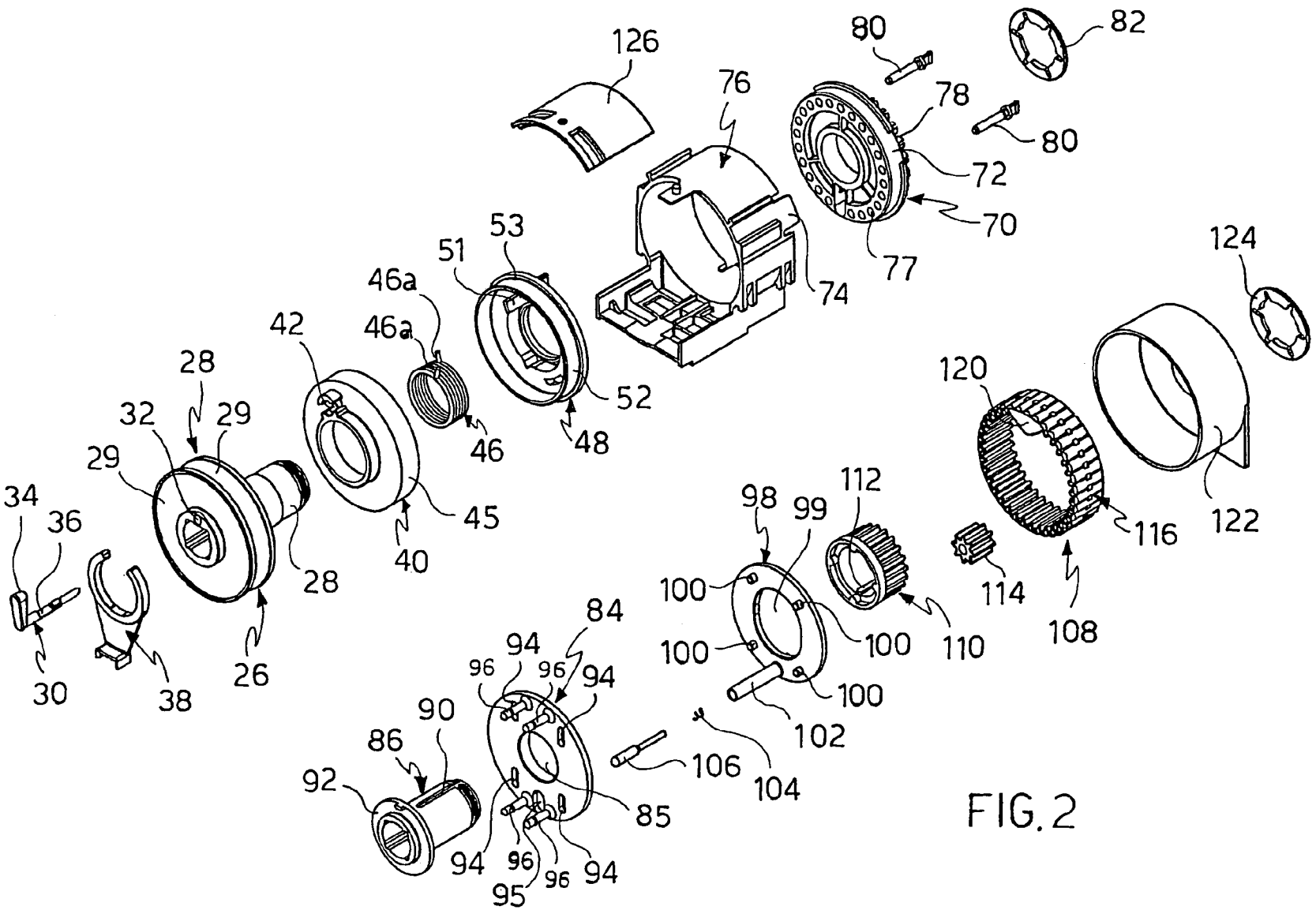
FIG. 2 is an exploded perspective view looking in the direction marked II in FIG. 1.
Figure 13:
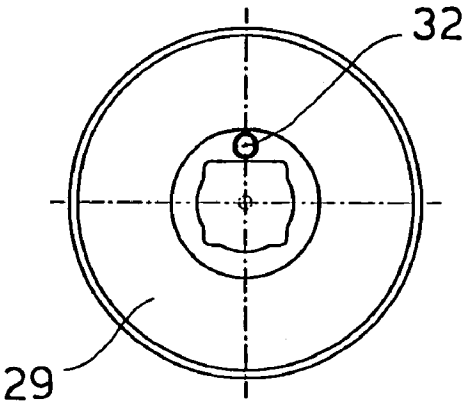
FIGS. 11-14 are enlarged front end, side, rear end and axial sectional (on the plane XIV-XIV) views, respectively, of a detail of FIG. 1.
Figure 14:
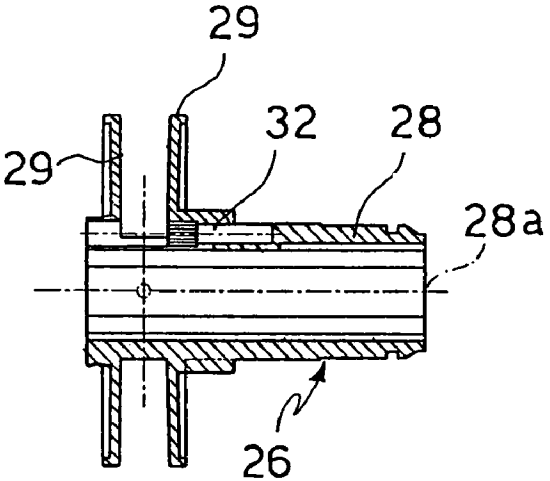
Figure 12:
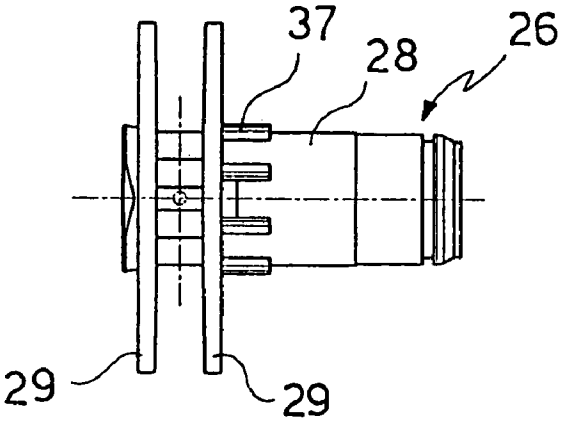
Figure 11:
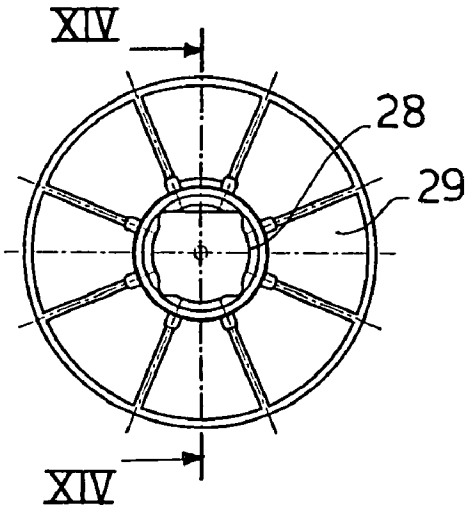
Figures 15, 16, 17, 18, 19:
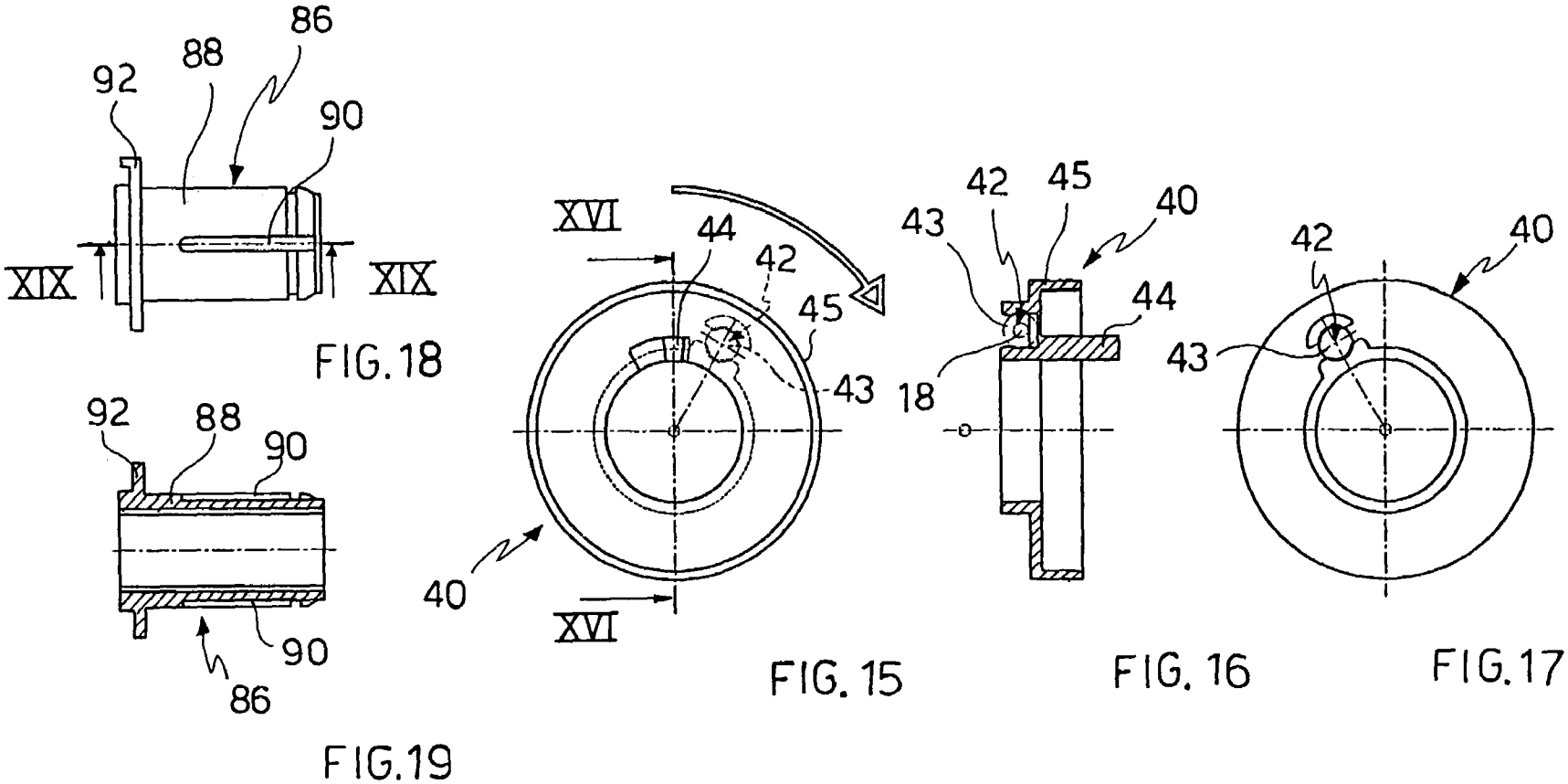
FIGS. 15-17 are enlarged front end, sectional (on the plane XVI-XVI) and rear end views, respectively, of a detail of FIG. 1.
FIGS. 18-19 are enlarged side and axial sectional (on the plane XIX-XIX) views, respectively, of a detail of FIG. 1.
Figure 21:
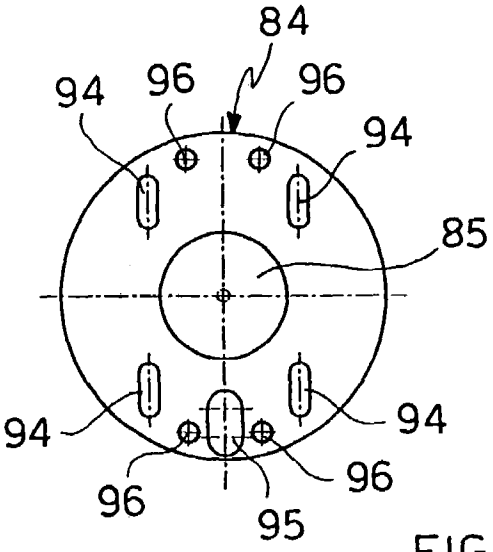
FIGS. 20-22 are enlarged front end, sectional (on the plane XXI-XXI) and rear end views, respectively, of a detail of FIG. 1.
Figure 22:
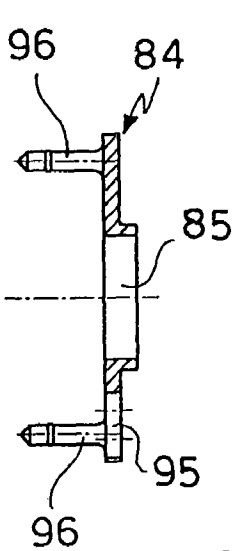
Figure 20:
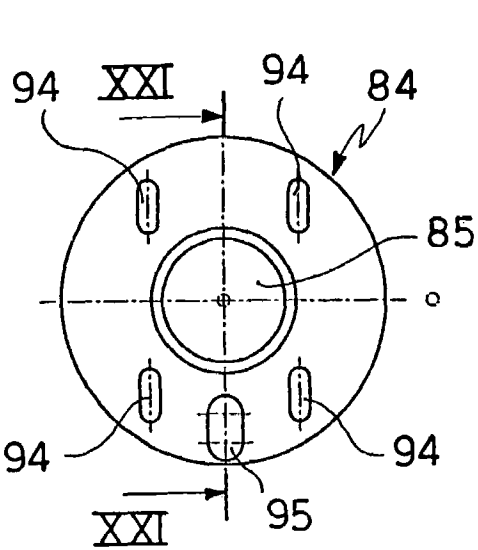
Figure 25:
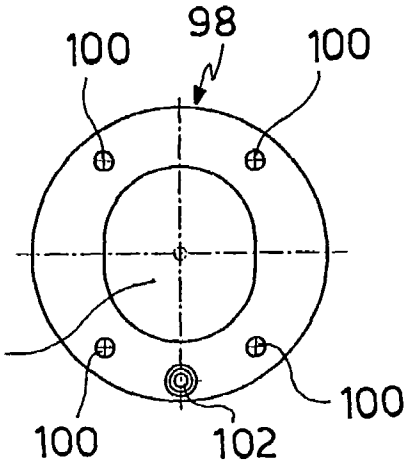
FIGS. 23-25 are enlarged front end, sectional (on the plane XXIV-XXIV) and rear end views, respectively, of a detail of FIG. 1.
Figure 24:
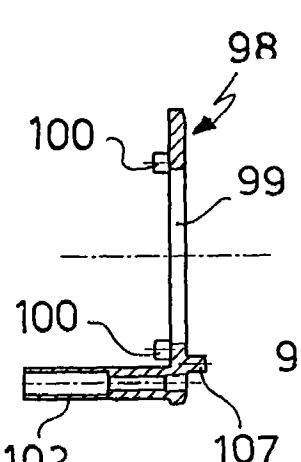
Figure 23:
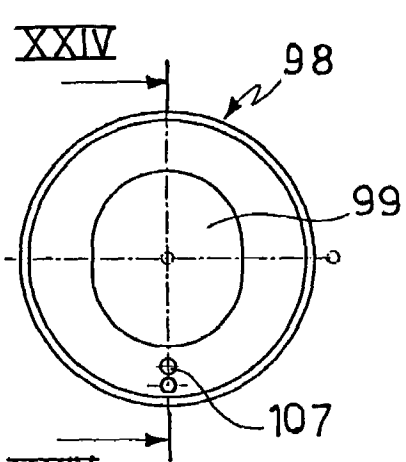
Figure 27:
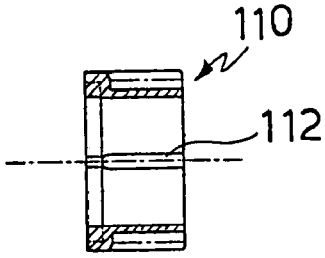
FIGS. 26-29 show an enlarged detail of FIG. 1 in front end, sectional (on the plane XXVII-XXVII), rear end and sectional (on the plane XXIX-XXIX) views, respectively.
Figure 26:
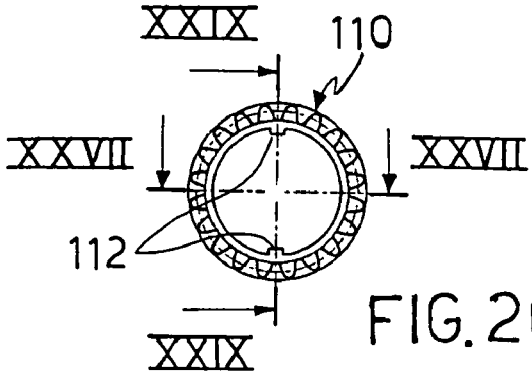
Figure 29:
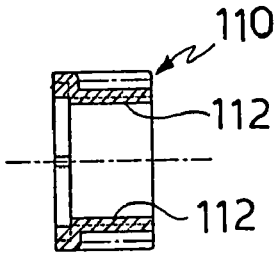
Figure 28:
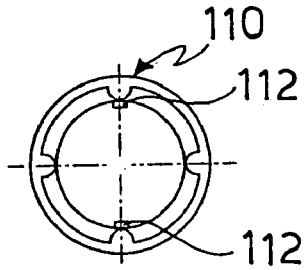
Figure 31:
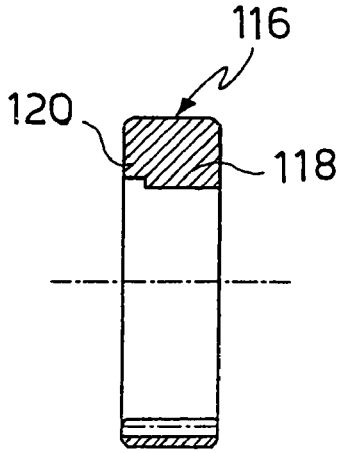
FIGS. 30-31 are enlarged end and axial sectional views, respectively, of a detail of FIG. 1.
Figure 30:
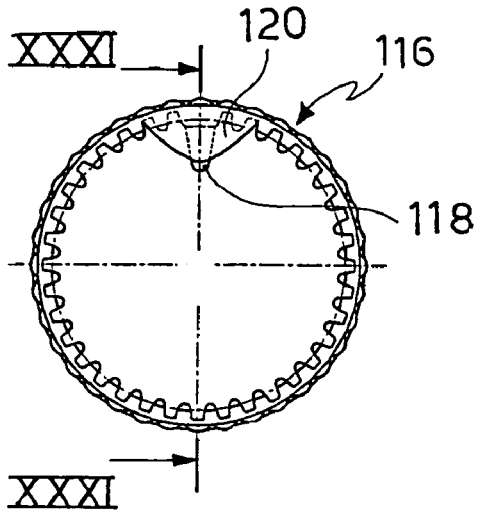
Figure 33:
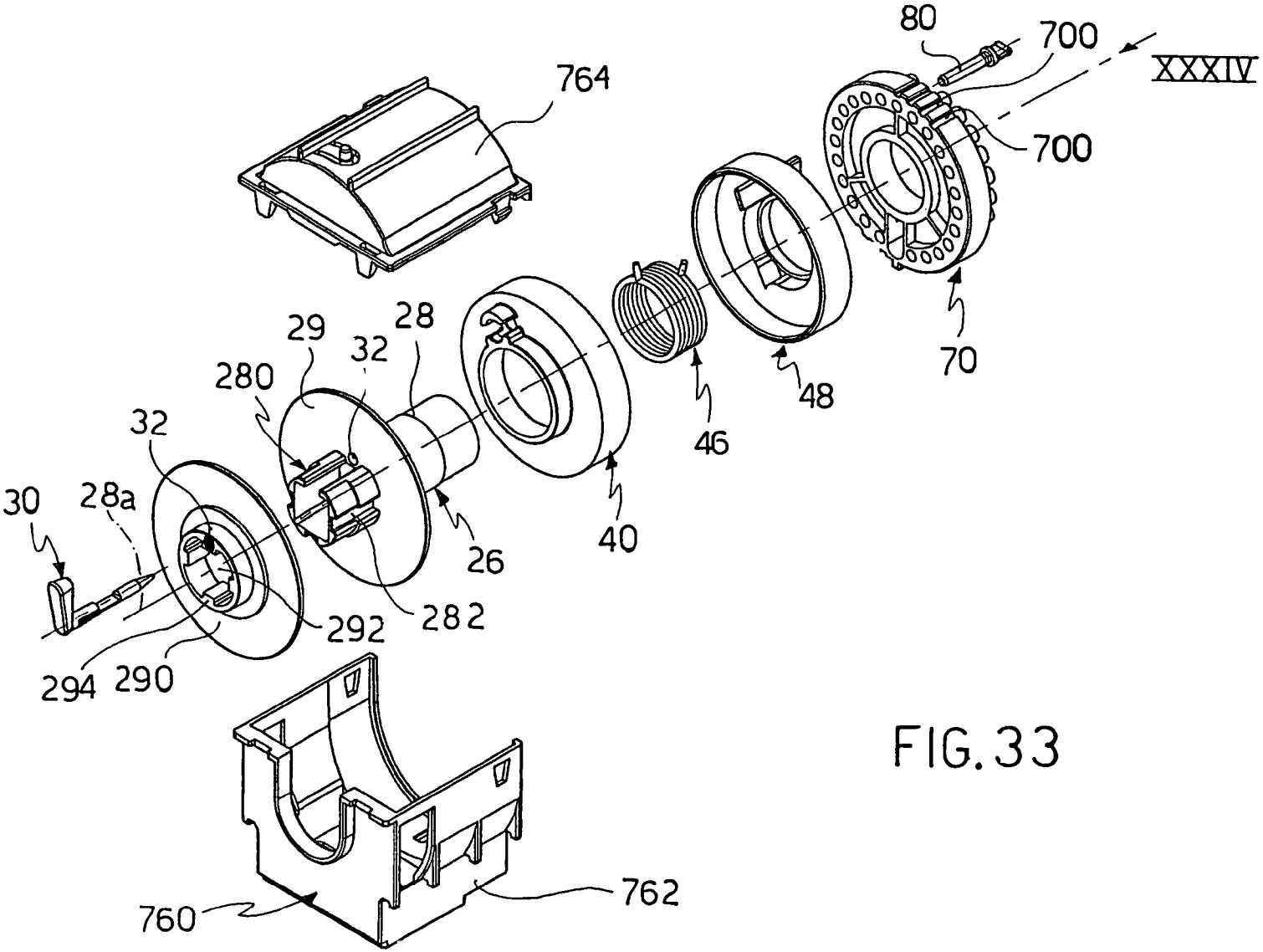
FIG. 33 is an exploded perspective view of a possible embodiment of a portion of the apparatus according to the present invention.
Figure 34:
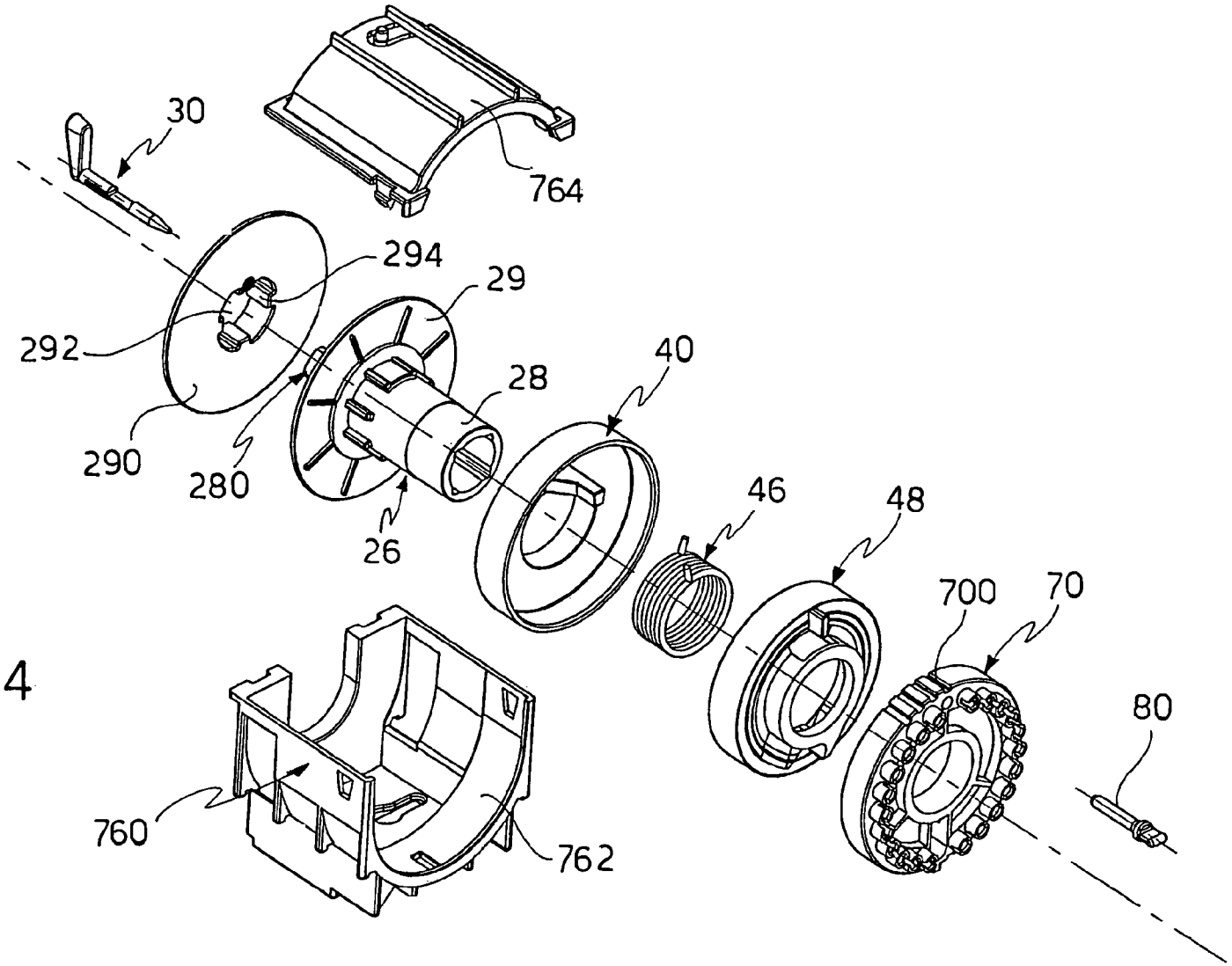
FIG. 34 is an exploded perspective view of the portion of the apparatus viewed in the direction XXXIV of FIG. 33.
Figure 35:
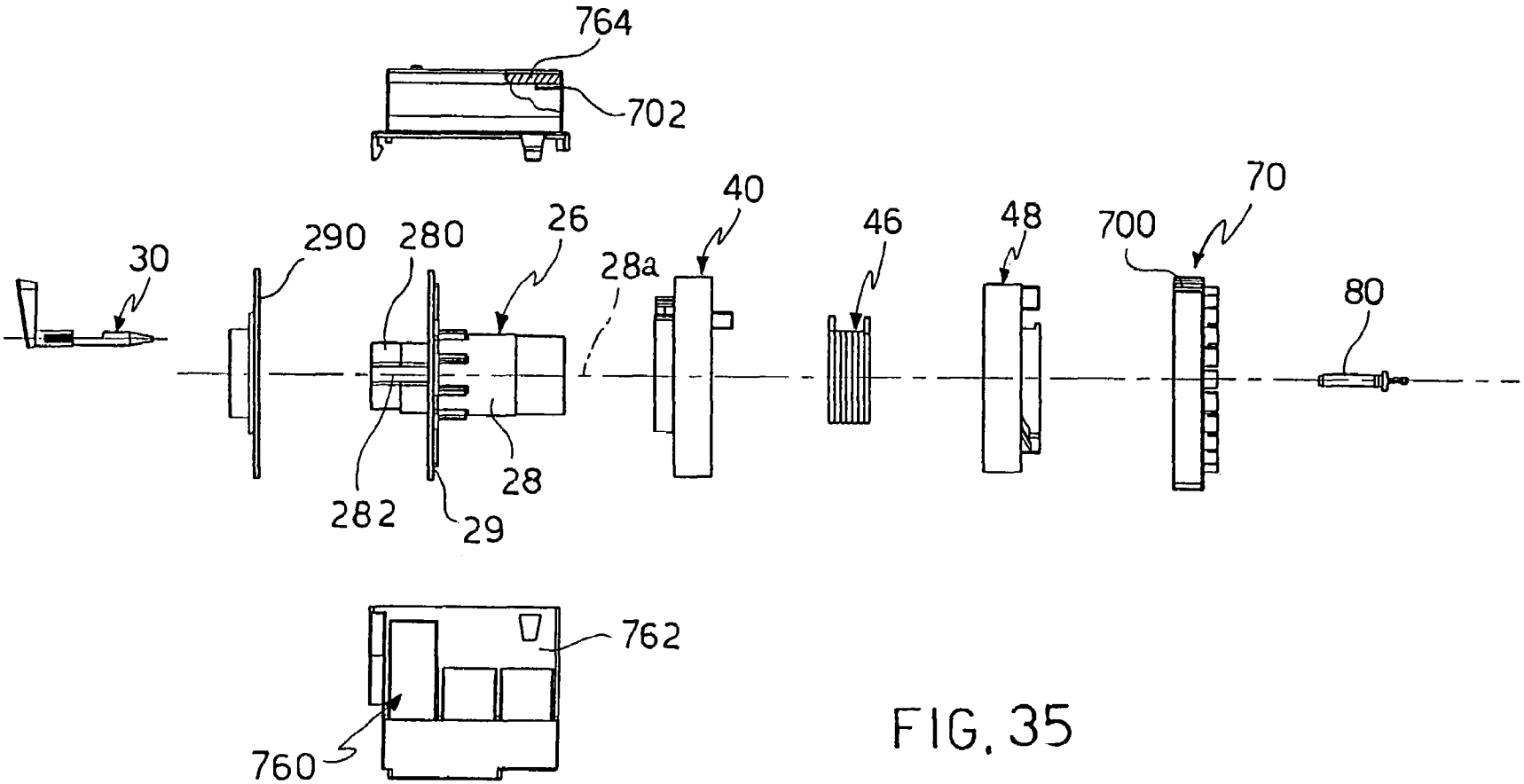
FIG. 35 is an exploded side view of the portion of the apparatus of FIG. 33.
Figure 36:
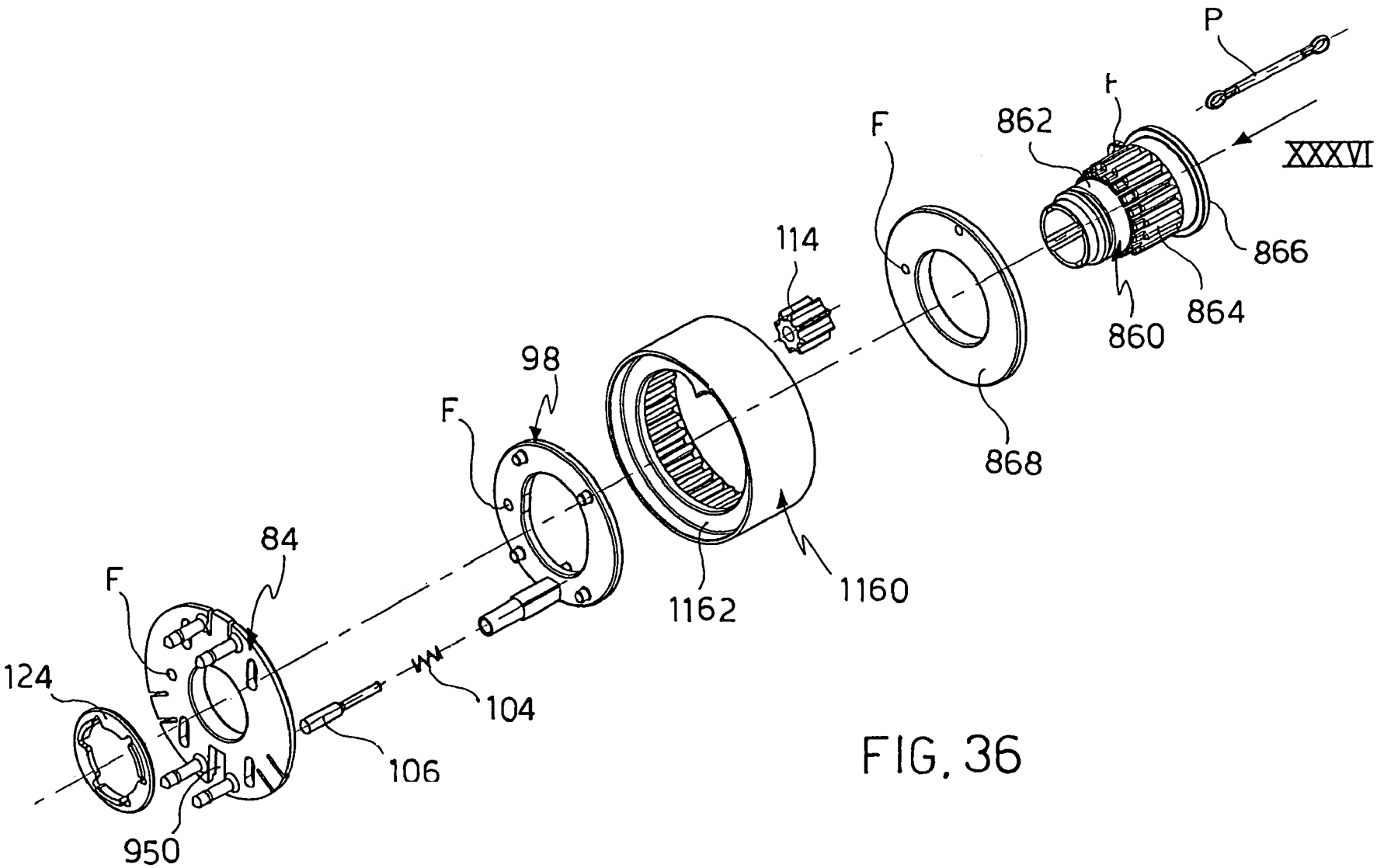
FIG. 36 is an exploded perspective view of a possible embodiment of a portion of the apparatus according to the present invention.
Figure 37:
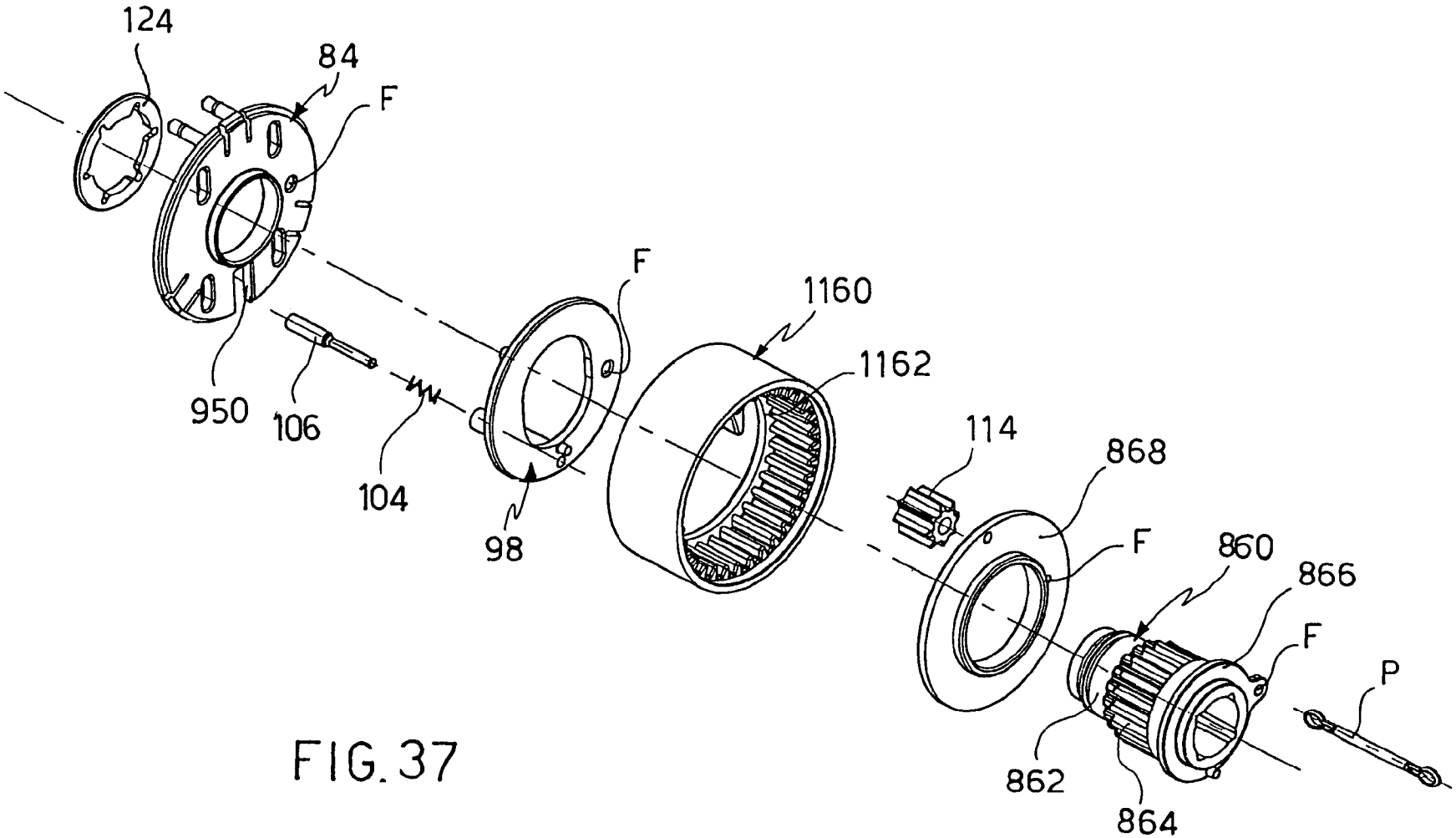
FIG. 37 is an exploded perspective view of the portion of the apparatus shown in the direction XXXVII of FIG. 36.
Figure 38:
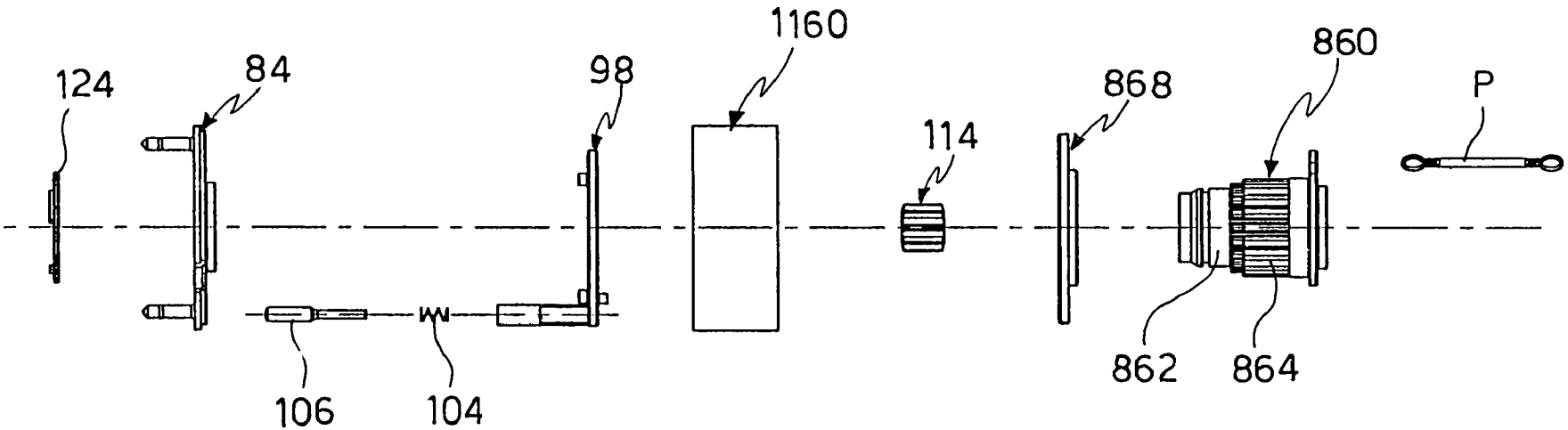
FIG. 38 is an exploded side view of the portion of the apparatus of FIG. 36.
Figure 39:
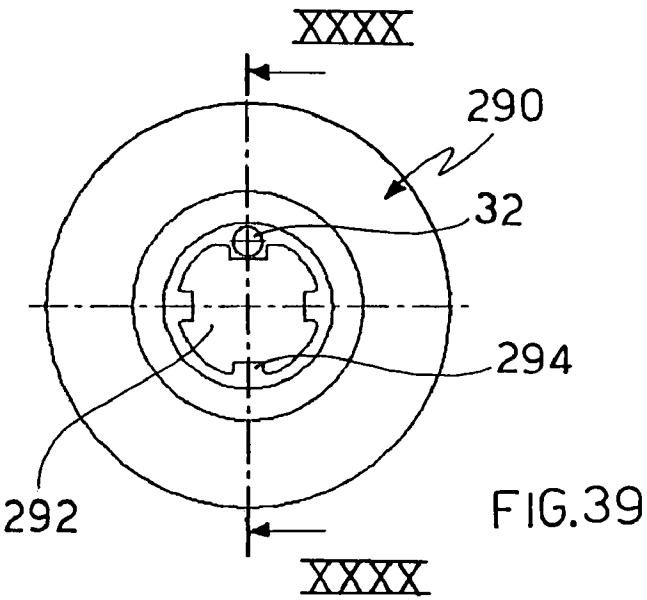
FIGS. 39 and 40 are an end view and sectional view (on the plane XXXX-XXXX), respectively, of a detail of FIG. 33.
Figure 40:
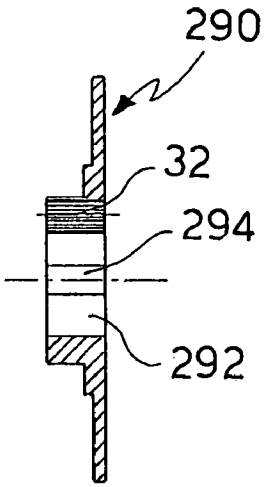
Figure 43:
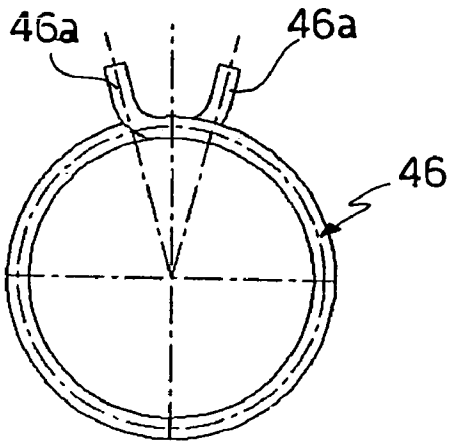
FIG. 43 is an end view of a detail of FIG. 33.
Figure 42:
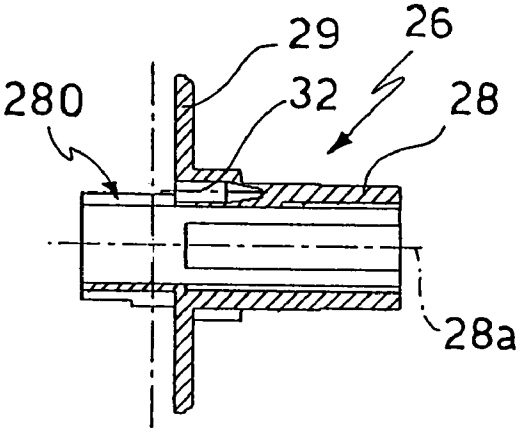
FIGS. 41 and 42 are a side view and a sectional view (on the plane XXXXII-XXXXII), respectively, of a detail of FIG. 33.
Figure 41:
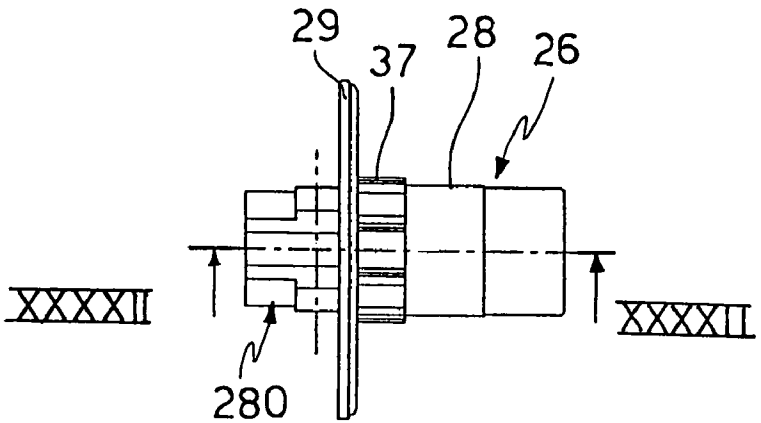

FIGS. 36-38 illustrate one possible embodiment of the portion of the apparatus that activates and deactivates the "third position" and which is equally applicable to the portion illustrated in FIGS. 33-35 and to that illustrated in FIGS. 1 and 2, replacing the embodiment shown therein.

Figure 57:
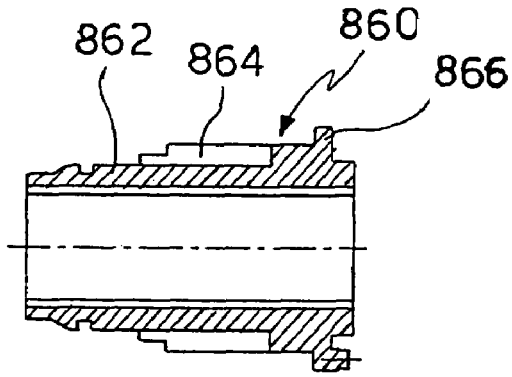
FIGS. 56-57 are enlarged end and sectional (on the plane LVII-LVII) views, respectively, of a detail of FIG. 36.
Figure 56:
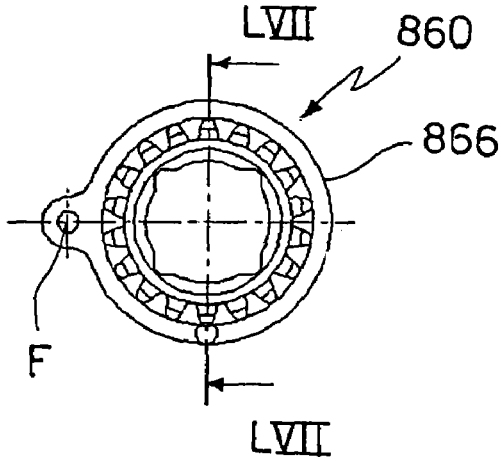

In one possible embodiment (FIGS. 56 and 57), the additional spool 86 and the first toothed element 110 seen in FIGS. 1 and 2 are produced in one piece or are replaced by an additional spool 860 having a hollow shaft 862 whose outer surface has a portion 864 machined to form external teeth. The additional spool 860 is designed to be inserted axially into the central hole 85 in the release ring 84 from the opposite side to that illustrated in FIGS. 1 and 2. Hence the stop ring 124 placed on the free end of the additional spool 86 is situated between the release ring 84 and the cam element 70. The additional spool 860 also includes a flange 866 situated on the other side from the end with the stop ring 124 and designed to be placed against an annular wall 868.

One possible embodiment has a third toothed element 1160 which includes a cylindrical wall with no bases, the inside surface of which has been machined to produce internal teeth. An annular rib 1162 faces the slider 98 in such a way that the latter is placed against it. The annular rib 1162 also defines an axial stop for the second toothed element 114.

In one possible embodiment, the portion that activates and deactivates the "third position" does not include a casing. The third toothed element 1160, the annular wall 1162, the slider 98, the release ring 84 and the annular wall 868 are produced in such a way as to form a containment box for the lost-motion means 108. This containment box may be fitted to a portion that packs and orients the slats by means of the pins 96 of the release ring 84.

Figure 52:
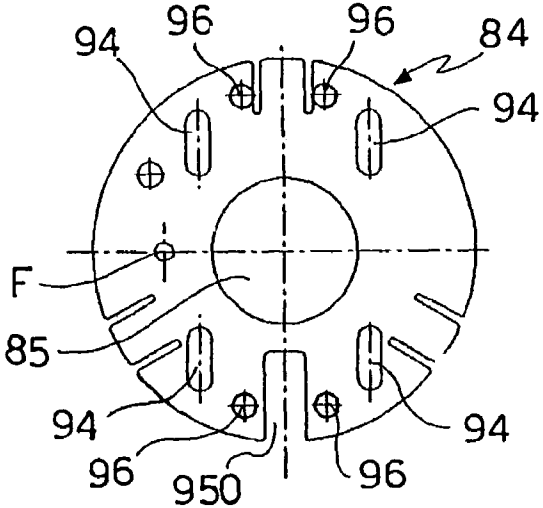
FIGS. 50-52 are enlarged front end, sectional (on the plane LI-LI) and rear end views, respectively, of a detail of FIG. 36.
Figure 51:
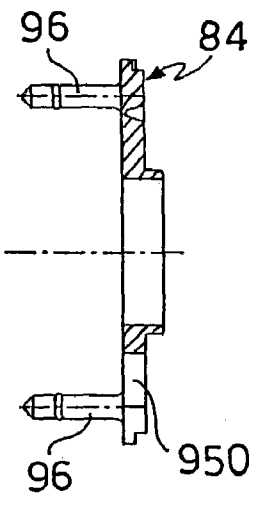
Figure 50:
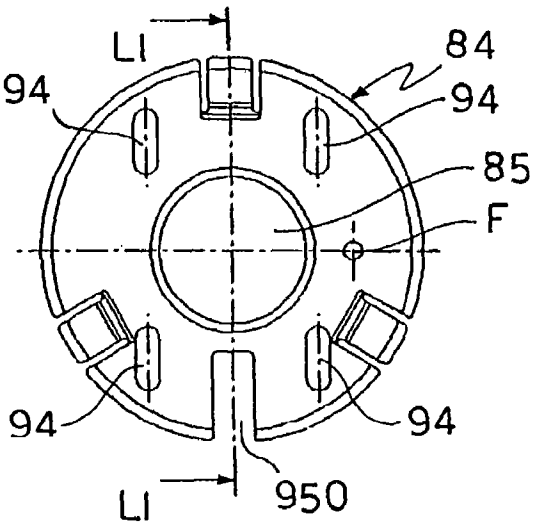
Figure 55:
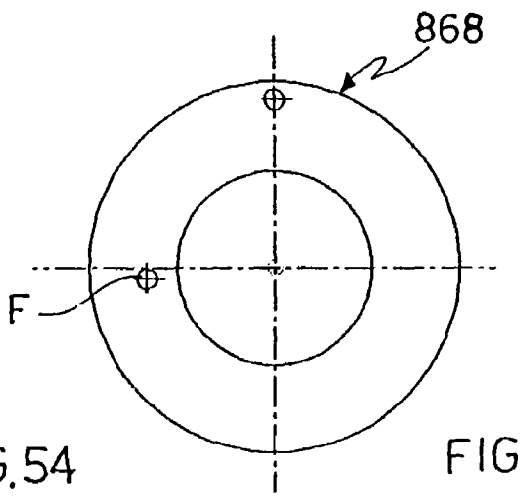
FIGS. 53-55 are enlarged front end, sectional (on the plane LIV-LIV) and rear end views, respectively, of a detail of FIG. 36.
Figure 54:
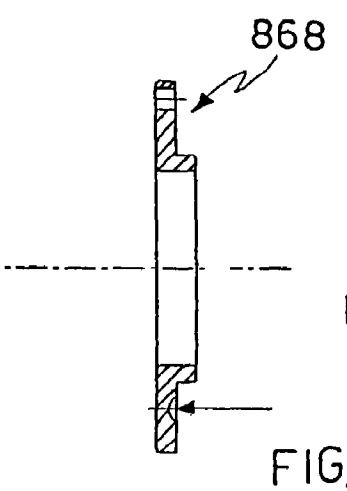
Figure 53:
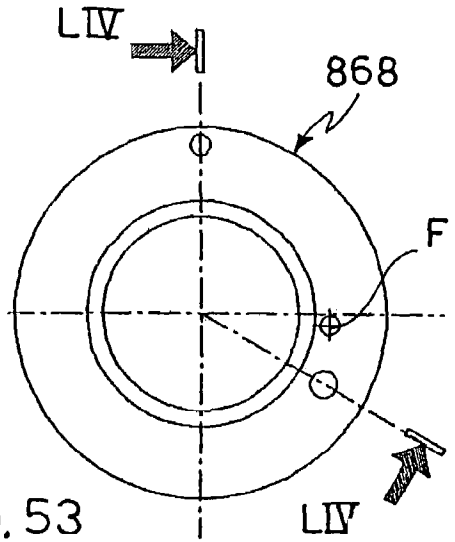

In one possible embodiment, the elongate slot 95 of the release ring 84 is replaced by an outwardly open radial slot 950 (FIGS. 50-52).

In one possible embodiment, the apparatus 10 comprises a pin P inserted parallel to the axis 28*a* to prevent changes, after assembly on a special jig, in the relative positions of the parts that form that portion of the apparatus which activates and deactivates the third position. The pin P must be removed before the apparatus is operated. In the example illustrated in FIGS. 36-38, all the parts of the portion for activating and deactivating the "third position" have a hole F to take the pin P.

To fulfil any specific requirements which may arise, numerous modifications, adaptations and replacement of parts with other functionally equivalent parts may be made by those skilled in the art to the preferred embodiment of the apparatus described above, without however departing from the scope of the claims which follow.

What is claimed is:

1. A Venetian type blind, comprising a plurality of slats, means for packing and extending the slats, means for adjusting the angular position of the slats and lost-motion means interposed functionally between said packing and extending means and said adjustment means in such a way as to lock the said Venetian blind adjustment means after a predetermined number of rotations of an actuating shaft, wherein said lost-motion means comprise at least two toothed elements, one of which is capable of moving a slider to cause it to interact selectively with a stop element of said adjustments means, and wherein said means for adjusting the angular position of the slats comprise an annular line holder and a cam element of essentially annular shape, mounted coaxially on the actuating shaft, said annular line holder comprising means for gripping a line which controls the angular position of the slats, wherein an additional cam element is mounted idle coaxially on the actuating shaft and defines end stops for the cam element, said additional cam element comprising a tooth with a sprint-release action which will fit into a depression present on a base.

2. The Venetian type blind according to claim 1, wherein an internal cross section of the actuating shaft is adapted to create a positive fit with a drive shaft, further comprising shaft means for taking up an angle caused by play in joints of the drive shaft.

3. Apparatus for adjusting the position of the slats of Venetian blinds comprising means for packing and extending the slats comprising a spool with a hollow shaft which extends along an axis and two essentially circular flanges that extend at right angles to said axis defining an annular space around the shaft for a tape which raises and lowers the slats;

means for adjusting the angular position of the slats comprising an annular line holder and a cam element of essentially annular shape, mounted coaxially on the hollow shaft of the spool, said annular line holder comprising means for gripping a line which controls the angular position of the slats wherein the hollow shaft turns, by means of a spring, the line holder which turns the cam element, wherein an additional cam element is mounted idle coaxially on the hollow shaft and defines end stops for the cam element, said additional cam element comprising a tooth with a spring-release action which will fit into a depression present on a base, and wherein said cam element comprises a first path defined by said end stop and a second path defining a stop element; and lost-motion means interposed functionally between said packing and extending means and said adjustment means in such a way as to lock said Venetian blind adjustment means after a predetermined number of rotations of an actuating shaft, wherein said lost-motion means comprise three toothed elements in functional sequence, wherein a first toothed element consisting of a cylindrical wall with external teeth is functionally connected to said slat packing and extending means, a second toothed element in the form of a planet gear defined by a cylindrical wall with external teeth is designed to mesh with the teeth of the first toothed element and a third toothed element comprising a cylindrical wall with internal teeth designed to mesh with the teeth on the second toothed element is functionally connected to said adjustment means and comprises a ramp formed by a wall whose edge has opposing inclinations and whose vertex is directed towards the axis of rotation, said ramp being capable of interacting with a slider, interacting with said cam element of said adjustment means, to move it between a free-movement position, corresponding to the first path of the cam element, and a locked position of the adjustment means, corresponding to the second path of the cam element, wherein said third toothed elements comprises a stop element for locking said toothed elements together, and wherein the three toothed elements fit inside each other, limiting the axial size of the apparatus.

4. Apparatus according to claim 3 wherein an internal cross section of the hollow shaft is adapted to create a positive fit with a drive shaft and further comprising means for taking up the angle caused by play in joints of the drive shaft.

5. Apparatus according to claim 4, in which said means for taking up the angle caused by the play in the joints of the drive shaft comprise slots formed in a side wall of one of the components of the apparatus and at least one rib on a casing.

* * * * *